United States Patent [19]

Sheldon

[11] 4,009,904

[45] Mar. 1, 1977

[54] SAFETY LEG FOR A CHAIR

[76] Inventor: Wesley E. Sheldon, 1835 - 31st St., Greeley, Colo. 80631

[22] Filed: May 21, 1975

[21] Appl. No.: 579,682

[52] U.S. Cl. ..... 297/217; 182/110; 248/206 R; 248/362

[51] Int. Cl.[2] ..... A47C 7/62

[58] Field of Search ..... 248/206 R, 362, 363, 248/351; 297/270, 310, 217; 182/166–168, 110

[56] References Cited

UNITED STATES PATENTS

| | | | |
|---|---|---|---|
| 377,995 | 2/1888 | Dougherty | 248/206 R |
| 482,645 | 9/1892 | Milks | 248/206 R |
| 961,093 | 6/1910 | Astor | 248/362 X |
| 1,006,315 | 10/1911 | Toth | 248/206 R |
| 1,147,102 | 7/1915 | Knabe | 248/206 R |
| 1,219,068 | 3/1917 | Bennett | 248/362 X |
| 3,878,573 | 4/1975 | Boudewyn | 248/206 R |

*Primary Examiner*—Ramon S. Britts
*Assistant Examiner*—William E. Lyddane
*Attorney, Agent, or Firm*—Wilbur A. E. Mitchell

[57] ABSTRACT

An auxiliary safety leg for a chair and adapted to be adjustably rigidly removably attached to an adjacent horizontal or vertical surface to prevent accidental falling of the chair.

3 Claims, 4 Drawing Figures

SAFETY LEG FOR A CHAIR

This invention relates to furniture individual chairs and stools.

Infants and small children, though usually strapped into a high chair, often cause the chair to rock or tilt over and fall. It is, therefore, a purpose of this invention to provide an operable attachment part of the chair, which the mother or attendant can easily operate to affix the chair sufficiently and removably to an adjacent surface to prevent such accidental tilting and falling of the chair by the child in the chair, and thus prevent resultant serious injury to the child.

Such an operable attachment must be easy to operate, without having to use tools, on the part of the mother or attendant, of economical construction, of few parts, and capable of accomplishing the result desired. Consideration must be had to its adaptability to function under different circumstances, such as where the chair is used on a hard surface floor, or, alternately, when used on a carpeted floor it must have adaptability for use to another adjacent surface to the chair instead.

It is a principal object of this invention to provide an auxiliary holding leg or arm secured to the chair and operably adapted for manual adjustment and removable rigid affixation to an adjacent horizontal or other surface near the chair, to effect a holding thereof to that other surface.

Another object is the provision of such a manually operable adjustable holding leg having an outer end operable suction cup affixation means.

Another object is the provision of such a manually operable adjustable holding leg having suction cup means at its outer end, and with the leg secured at its other end to a part of the chair, and with the leg being adjustably jointed between its ends for manual adjustment positioning of the longitudinal axis of the leg for adapting the suction cup means of the leg to be secured either to a horizontal or a vertical surface adjacent to the chair.

Other and further objects will be apparent to those skilled in the art from the following detailed description and from the drawings, in which.

Figure 1:
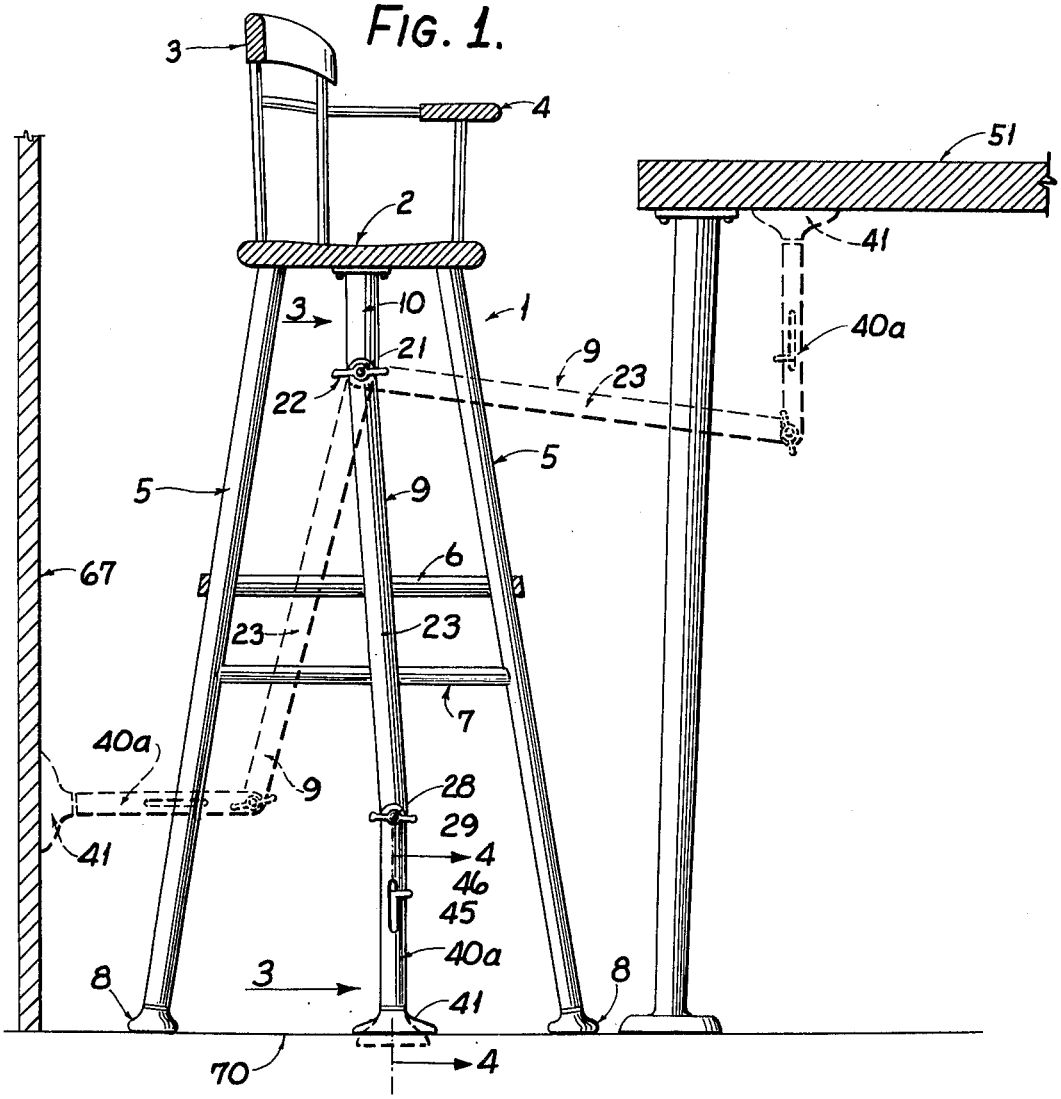
FIG. 1 is a side elevational view of a child's high chair showing a preferred embodiment of my invention in use, with the holding leg 9 thereof extending from and secured to the under side of the seat thereof.
Figure 4:
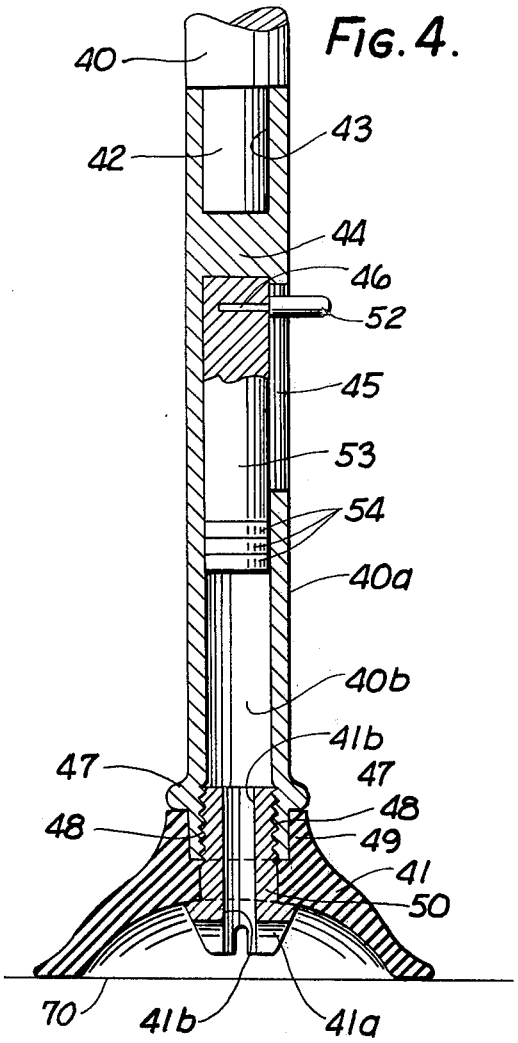

FIG. 4 is an enlarged vertical sectional view of the operable suction cup outer end portion of my holding leg, in operative use; and Referring to the drawings, in this preferred embodiment of my invention, a baby's high chair is partially cross-sectionally shown in FIG. 1, by reference numeral 1 generally. The chair has a seat 2, a back 3, a snap-lift tray and/or retainer 4, four legs 5, and cross-supports 6 and 7*a*. A cushion 8 is provided at each lower end of legs 5.

I provide a novel operable holding safety leg 9, secured centrally to the under side of the chair seat 2, as shown. Leg 9 comprises a plural jointed dog-leg composite leg member 10, 23 and 40. I provide a T-shaped bracket-arm 10, and conventionally screw-bolt fasten its upper cross bar end to the under side of the seat. Arm 10 is formed at the lower end thereof with a transverse bearing hole 20 therein, for receiving a snug fitting stud bolt 21 therethrough. Bolt 21 has its end screw-threaded for receiving an internally similar screw-threaded wing-nut 22 screw-threadedly mounted thereon, as will be explained.

I pivotally mount a bifurcated connecting rod 23, of the type shown, on the bolt 21, so as to extend arm 10 normally substantially vertically. Rod 23 has its upper end, as shown in FIG. 1, bifurcated into parallel fork arms 24 and with a pair of aligned transverse openings 25 in those arms, for the bolt 21 to extend through said openings and for 23 to normally pivotally hang on that bolt. A conventional lock-washer 22*a* is provided on bolt 21 between wing nut 22 and its adjacent arm 24. The third part of my novel dog-leg safety leg, 9, is a second bifurcated extension rod 40 having its upper end formed into a bifurcated pair of parallel fork arms 30. A pair of aligned openings 27 are formed through fork arms 30, to permit a bolt 28 to extend therethrough. The one end of 28 is screw-threaded. A lock-washer 29*a* is provided on that bolt, between the one fork 30 and an adjacent wing nut 29. Wing nut 29 is internally screw-threaded and adapted to be so threadedly mounted on bolt 28, as will be explained. Rod 40 normally hangs pivotally on bolt 28. A rubber suction cup 41 is secured to the lower end of rod 40. In use on a floor 70, as in FIG. 1, the jointed legs 10, 23 and 40 are always secured together as one dog-leg rigid unit, by their wing nuts being tight, as shown, on their respective bolts, so that the overall total length of leg 9 and its vacuum cup 41 is longer than that of any one chair support leg 4, so that an occupant sitting on the chair seat will cause a compression of the vacuum cup 41, as shown in solid lines of FIG. 1, by the occupant's weight, and create a vacuum holding by 41, even without the vacuum cup suction assist caused by a raising of the piston within the cylinder, as will be hereafter explained.

The lower part of lower rod 40, of my safety leg 9, is constructed conventionally as shown in FIG. 4, for the used to be easily able to effect a suction in the suction cup 41, to effect a suction cup holding by 41 to a surface, as illustrated. The lower extension arm 40, of safety leg 9, is formed of wood, with its extension from arms 30 formed into a reduced shank 42. The remainder of that arm 40 is an equal diameter hollow metal cylinder 40*a*, having a closure or internal divider wall 44 adjacent one end to form a socket 43 at that end. 43 is adapted to fit snugly over the shank 42, for a rigid carrying of 40*a*, by 42, in longitudinal extension alignment thereof. The cylindrical tube 40*a*, below divider wall 44, is provided with an elongated vertical slot 45, formed near its upper end, as shown in FIG. 4, below the wall 44 with a peripheral short lateral extension slot 46 therefrom, formed in 40*a* near the upper end of that slot 45, for purpose to be explained. The lower end of cylinder 40*a* has a peripherally extended flange 47 and at that end is provided with its internal bore 48 formed screw-threaded at 48.

A relatively large and strong rubber suction cup 41 is secured to the lower end of 40*a* below flange 47. 41 is formed with an upper hollow cylindrical central neck shank 49. Cup 41 is pre-formed integrally as shown, onto an inner upper collar ring 50, of the type shown, with 50's upper exterior formed screw threaded and matching the interior threads of extension 48, as shown. By this construction, it will be seen how cup 41 is air tight snugly fit and held over the lower end of tube 40*a* below flange 47, by threads of 48–50 matching, as the cup 41, with its integral inside collar 50, is screw fastened onto that lower end of 40*a*. 41*a* is an internal integral pre-formed support ring, of cup 41, around its central vertical opening, for reason to be explained. The opening 41*b* is in extension of the inside opening of collar 50, leading upwardly into the lower cylinder 40*a* portion 40*b* below the piston 53, to permit free air passage communication from inside cup 41 to and with the cylinder inside portion 40*b*, on assembly and use, as will be explained. A cylindrical piston 53 is adapted for sliding movement within cylinder 40*a*. The piston has a suitable transverse stub handle 52 secured, conventionally, as by being screw threaded into an opening provided therefor into its upper end, and with that handle 52 being slidable with the slot 45 and the lateral extension slot 46 thereof. Suitable leather or neoprene gaskets 54 are on the lower end of piston 53, for conventional air tight engagement between the piston and internal walls of cylinder 40*a*.

In operation, with the composite leg 9 extending downwardly, for securement of its cup 41 onto a hard surface floor 70, with the leg 9 slightly dog-leg bent, in a dog-leg or substantially straight line, and with the suction cup resting normally of floor 70, before being compressed onto the floor, and with piston 53 at the lower end of cylinder 40*b*, the operator, or child's mother, first substantially tightens both wing nuts 22 and 29, and then she slidably moves the piston upwardly in 40*b*, by the handle 52, and thus by that pump-like movement creates thereby a vacuum below the piston 53 within the members 40*b* and 41*b* and under 41, and thus effects compression of 41 by and air tightening vacuum of the periphery in 41 onto the hard surfaced floor 70, thereby effecting a holding of 41 onto that floor, as in full lines of FIG. 1. On that raising of piston 53, on reaching the uppermost piston sliding movement position, the operator then moves the handle 52 laterally into the transverse slot 46, for maintaining that 41 vacuum condition holding. That vacuum holding of 41 holds the chair through leg 9, from tipping. The lock wing nuts 24 and 29 are adapted for a manual tightening by the operator. That tightening assists the chair holding by leg 9 and its 41 and prevents a tipping of the chair until the vacuum in 41 is released. The piston may be unlocked when it is desired to release its such vacuum making position, by rotating handle 52 peripherally back into alignment with its adjacent vertical slot 45, and then moving the piston in 40*b* downwardly, to the lower end of the slot 45 distance. The weight of the child on the chair is partially carried by the inner cushion support ring 41*a*, and that ring assures maintenance of the vacuum in 41, on use, from being broken by an otherwise a flatening of cup 41 by that weight, as will be understood. Slot 41*a* permits the vacuum passage communication between the underside of 41 and interior of cylinder 40*b*.

Figure 3:
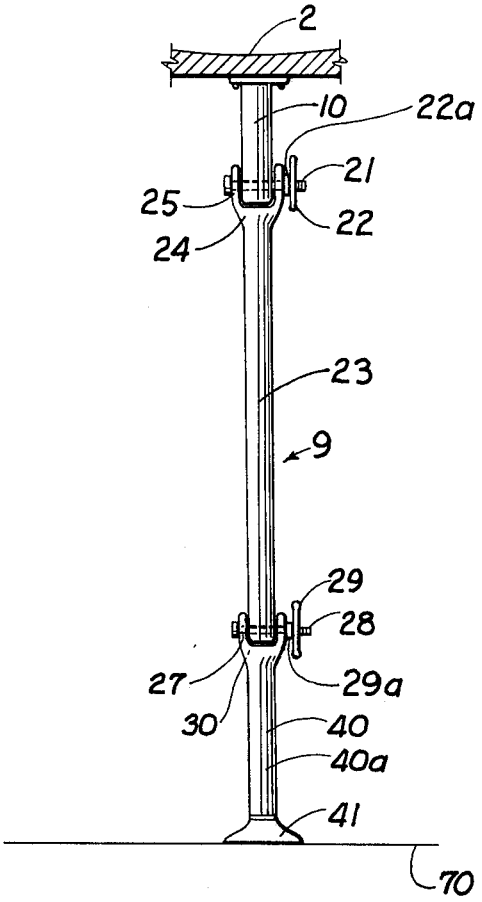
FIG. 3 is side elevational view of my novel jointed holding leg portion of FIG. 1, taken from and in the direction of the arrows 3—3 of FIG. 1.

Whereever the floor, on which the chair is used, is incompatable for such suction cup 41 affixation thereto, as when the floor is rug covered, I have jointed my safety holding leg 9, as shown in FIGS. 1, 3 and 4 and by dotted lines illustrating how my jointed safety leg 9 may be used. It will thus be seen how, by my novel jointed leg 9, I can effect an alternate safety holding thereby to another adjacent surface, such as to an adjacent vertical wall 67, or to the under side of an adjacent table 51, as illustrated by the dotted lines of leg 9 in FIG. 1. Wing nuts 22 and 29 are first manually loosened by the operator or mother, permitting the dog-leg like 9 pivotal movement of rods 23 and 40*a*, on their respective pivot bolts, 21–28, to place the composit leg 9 into a desired dotted line position, as, for example, to effect a leg securement to an adjacent table, as shown, and then she operates the piston 53, by its handle 52, to create the vacuum, as heretofore explained, to effect a vacuum cup 41 holding of the chair, by vacuum cup 41, in co-operation with its arm 9, to that table, and then she tightens both wing nuts 22 to 29 to assist in such holding.

While I illustrate and explain my novel chair safety leg use with an infant's high chair, I do not wish to be limited thereby, as it is to be understood that this invention may be used with any other type of chair or seat, such as where it is desirable to have the seating chairs, stools or the like removably arranged and held in place, such as at a lunch counter, a bar, a soda fountain, in a theatre or other public meeting halls.

My novel three segment 10, 23 and 40 safety leg 9 comprises a manually adjustable dog-leg safety leg removable means. While the segmental dog leg 9 is shown as pivotally connected together by its pivot bolts, in its vacuum cup safety holding use, it is to be understood that in use it is always secured together rigidly against such pivoting by its wing nuts being tightly screw-seated to prevent such a pivoting from defeating the purpose of the chair safety holding by 9 from tilting. The pivotal adjustment capability is to permit its pre-use positioning, as explained, for adapting use to either a horizontal or vertical adjacent surface. Leg 9 is to pivotally constructed to permit its manual adjustment into any one of several holding positions, to secure the chair from tipping by affixing vacuum cup 41 either to the floor, or an adjacent other surface, such as a vertical wall or under side of an adjacent table, as illustrated by dotted lines in FIG. 1.

Figure 2:
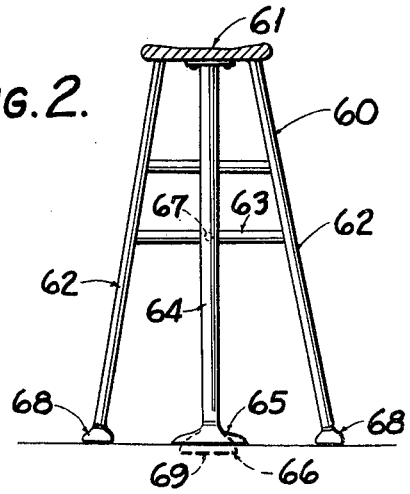
FIG. 2 is an elevational side view of a modification of my holding leg invention and as used with a bar lunch counter stool, or such use stool.

I illustrate other uses of my novel safety leg invention, for chairs generally in addition to the heretofore detailed description disclosure as used with a baby chair, in my reduced FIG. 2. By FIG. 2, I illustratively show the use of my invention with an ordinary kitchen breakfast counter or restaurant bar chair-stool 60, and in a modified form within the spirit and teaching of my invention. That stool has the conventional seat 61, legs 62, cross supports 63 and leg lower end cushions 68. With this stool, I illustrate a one-piece rigid affixed extra safety leg 64, on the lower end of which I secure a conventional large suction cup, 65, similar to the construction of a conventional bathroom toilet suction cup plunger construction. That leg 64 and its cup 65 are so constructed and affixed together, as shown in terms of length distance from the under side of seat 61 to the under lip edge 69 of the cup, that said overall distance length of 64–65 is greater than the overall length of each leg 62 and its cushion 68. The before use normal extension distance of that vacuum cup 65 on the safety leg 64 is shown in dotted lines of FIG. 2 at 69. Such overall extra length of leg 64 and its vacuum cup 65, over the length of a support leg 62, is designed to permit the weight of the occupant on the stool, on seat 61, to thereby cause the needed resultant downward compression of the cup 65 into the full line 65 position shown, for thereby effecting an automatic vacuum holding of the stool by members 64 and 65, against a tilting of the stool. Then upon the occupant getting off the stool—there tends to be an automatic release of the vacuum in cup 65 by the normal live rubber tension of 65 raising 65 upwardly, which breaks the vacuum, and then the stool may be moved until the next occupant's use sitting thereon.

My novel holding leg may be secured to any other part of the chair-stool, suh as to its back, supporting legs, cross supports between supporting legs or a midway platform between the supporting legs specially for the purpose.

The rubber suction cup is of the type to be normally strongly resilient and collapsible by downward pressure exerted at its upper center, as by the leg of FIG. 2, or by a vacuum formed therein, as FIGS. 1, 3 and 4. On release of any such pressure, said resiliency is strong enough to cause the vacuum cup to resume its normal dotted line shape, indicated in FIGS. 1 and 2. Referring to FIG. 2, that latter resumption of shape resilient movement raises one side of the chair. Thus, by an occupant sitting on the seat of the chair-stool, as in FIG. 2, the downward weight resultant pressure causes an automatic suction cup compression and resultant vacuum holding—and when the occupant gets off the chair the vacuum cup resiliency raises the rod and chair sufficiently to automatically release the vacuum holding until again occupied.

Having thus explained in detail several modifications of my invention, I wish to be limited in the spirit, teaching and scope thereof only by the hereunto appended claims.

What I claim and desire to be secured by letters patent is:

1. In combination with a chair having a seat and downwardly extending legs to rest upon a floor and an anchoring surface adjacent to the chair, a safety holding leg secured to the undersurface of said seat, with said leg having a top portion, an intermediate and a terminal portion, said safety holding leg including a first articulated joint near the undersurface of the seat to permit the intermediate leg portion, below the said top portion, to be angled laterally from the top portion, and including a second articulated joint remote from the undersurface of the seat to define the extended end of the intermediate portion, with said terminal portion extended beyond the end of the intermediate portion, to be angled with respect to the intermediate portion, whereby the safety holding leg can be shifted to various positions to permit the extended end of the terminal portion to reach and engage an anchoring surface, by a holding means carried by that end of the terminal portion, with said holding means being adapted to connect the terminal portion to the anchoring surface.

2. In combination with a chair having a seat and downwardly extending legs to rest upon a floor and an anchoring surface adjacent to the chair, a safety holding leg secured to the undersurface of said seat as defined in preceding claim 1, and further defined with said terminal portion end being so connected substantially at a right angle to the anchoring surface by the holding means.

3. In combination, a chair having a seat and a plurality of supporting legs, and an auxiliary jointed manually adjustable safety dog-leg holding means for the chair, said dog-leg holding means being longer than one of said supporting legs and having an operable piston-cylinder vacuum cup compressible holding means secured to an end of the safety dog-leg holding means and adapting the dog-leg holding means for securement by its vacuum cup means to one of an adjacent horizontal or vertical surface upon operation of the piston-cylinder vacuum cup compressible means, said safety dog-leg holding means comprising plural adjustably jointed rods, and with one of the rods having the piston-cylinder in extension thereof with the piston operable in the cylinder and the vacuum cup extension as a part of the cylinder, whereby operation of the piston in one direction will effectuate a vacuum within the cylinder and vacuum cup means for effecting a vacuum cup vacuum compression for vacuum holding to an adjacent surface when and to which the vacuum cup is first applied, and said longer length of said dog-leg holding means being defined as including the vacuum cup holding means before compression thereof.

* * * * *

UNITED STATES PATENT OFFICE
CERTIFICATE OF CORRECTION

Patent No. 4,009,904 Dated March 1, 1977

Inventor(s) Wesley E. Sheldon

It is certified that error appears in the above-identified patent and that said Letters Patent are hereby corrected as shown below:

Column 3, line 27, "of" should be -- on --.

Column 3, line 35, before "compression" insert -- a --.

Column 3, line 36, delete "ening" and delete "of the periphery".

Column 4, line 34, "to" second occurrence should read -- so --.

Column 5, line 6, "suh" should read -- such --.

Signed and Sealed this

Third Day of May 1977

[SEAL]

*Attest:*

RUTH C. MASON
*Attesting Officer*

C. MARSHALL DANN
*Commissioner of Patents and Trademarks*

UNITED STATES PATENT OFFICE

CERTIFICATE OF CORRECTION

Patent No. 4,009,904 Dated March 1, 1977

Inventor(s) Wesley E. Sheldon

It is certified that error appears in the above-identified patent and that said Letters Patent are hereby corrected as shown below:

Column 3, line 27, "of" should read -- on --.

Column 3, line 35, before "compression" insert -- a --.

Column 3, line 35, after "air" delete "tight-".

Column 3, line 36, delete "ening" and delete "of the periphery"

Column 4, line 34, "to", first occurrence, should read -- so --.

Column 5, line 7, "suh" should read -- such --.

This certificate supersedes Certificate of Correction issued May 3, 1977.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*